US006702628B2

(12) United States Patent
Tanaka et al.

(10) Patent No.: US 6,702,628 B2
(45) Date of Patent: Mar. 9, 2004

(54) CONNECTOR AND A METHOD OF ASSEMBLING IT

(75) Inventors: Tsutomu Tanaka, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/349,522

(22) Filed: Jan. 22, 2003

(65) Prior Publication Data

US 2003/0143891 A1 Jul. 31, 2003

(30) Foreign Application Priority Data

Jan. 31, 2002 (JP) ..... 2002-023932

(51) Int. Cl.[7] ..... H01R 13/514
(52) U.S. Cl. ..... 439/752; 439/701; 439/595
(58) Field of Search ..... 439/752, 745, 439/741, 701, 595, 843, 752.5

(56) References Cited

U.S. PATENT DOCUMENTS 5,322,456 A * 6/1994 Yagi et al. ..... 439/595
5,609,503 A * 3/1997 Tsuji et al. ..... 439/752
5,653,613 A * 8/1997 Shimoda ..... 439/752
6,059,612 A * 5/2000 Aoyama et al. ..... 439/701
6,155,888 A * 12/2000 Kurimoto ..... 439/752
6,296,531 B1 * 10/2001 Nagamine ..... 439/752
6,341,985 B2 1/2002 Kodama
6,527,583 B2 * 3/2003 Plate ..... 439/489

* cited by examiner

*Primary Examiner*—Gary Paumen
*Assistant Examiner*—X. Chung-Trans
(74) *Attorney, Agent, or Firm*—Gerald E. Hespos; Anthony J. Casella

(57) ABSTRACT

A connector housing (10) has a wide cavity group (11L) and a narrow cavity group (11S). A front holder (30) is mounted to the front of the housing (10), but corresponds only to the narrow cavity group (11S). Thus, the front holder (30) has a small area as compared to a front holder corresponding to all the cavities. Accordingly, a degree of shrinkage of the front holder (30) during resin molding is suppressed, thereby making a dimensional variation of the front holder (30) smaller. As a result, displacements between the smaller cavities (12S) and the portions of the front holder (30) corresponding to the smaller cavities (12S) are suppressed.

15 Claims, 10 Drawing Sheets

CONNECTOR AND A METHOD OF ASSEMBLING IT

BACKGROUND OF THE INVENTION

1. Field of the Invention

The invention relates to a connector with a front holder.

2. Description of the Related Art

A connector has a housing with cavities and locks that are cantilevered from inner walls of the cavities. Terminal fittings are inserted into cavities and are locked by the cantilevered locks. The terminal fittings and the cavities easily can be made narrower to achieve miniaturization. However, the locks must be sufficiently strong to lock the terminal fittings. Thus, the locks must be substantially as wide as the cavities. As a result, supports for supporting the opposite sides of the front ends of the terminal fittings cannot be provided in an area where the cavities and the locks face each other and an area before the locks. Alternatively, the width of any supports that can be formed is very small and the supports cannot be expected to support the terminal fittings securely.

U.S. Pat. No. 6,341,985 discloses a connector with a front holder mounted on the front of the housing. The holder has support walls for the front ends of the terminal fittings and front-stop walls for the cavities. Thus, the walls of the front holder can support the front ends of the terminal fittings.

The connector disclosed in U.S. Pat. No. 6,341,985 is a hybrid connector with a group of narrow cavities a group of wide cavities. It is difficult to form supports for supporting the front ends of the terminal fittings in the narrow cavities. However, it is easier to form supports for supporting the front ends of the terminal fittings in the wider cavities. The front holder of the connector shown in U.S. Pat. No. 6,341,985 is a single plate that corresponds to both the narrow cavities and the wide cavities.

The front holder of U.S. Pat. No. 6,341,985 becomes very large if the connector has a large number of cavities. However, a large front holder shrinks significantly during resin molding and creates dimensional variations, including displacement of the openings in the holder relative to the cavities.

Displacements of openings of the holder relative to the cavities cause portions of the terminal fittings that engage the front holder to be displaced from their proper positions. An electrical connection testing jig and a jig used to withdraw the terminals are inserted into the cavities through the openings of the front holder. However, misalignment of the openings in the holder may prevent proper insertion and maneuvering of the jigs.

The present invention was developed in view of the above problem and an object thereof is to prevent displacements of portions of a front holder corresponding to cavities from the cavities.

SUMMARY OF THE INVENTION

The invention relates to a connector with a housing with cavities and locks that extend along the inner walls of the respective cavities. Terminal fittings are inserted into the corresponding cavities and are locked by the locks. The cavities include at least first and second cavity groups. The cavities in the first cavity group have supports for supporting front ends of the terminal fittings. However, cavities in the second cavity group have no supports. The housing is assembled with a front holder that corresponds only to the second cavity group. The front holder forms front ends of the cavities of the second cavity group and includes supports for supporting the front ends of the terminal fittings inserted into the cavities of the second cavity group.

The front holder corresponds to only the second cavity group and thus has a smaller area as compared to a front holder that corresponds to all cavities or more cavities than the second group. Thus, the degree of shrinkage of the front holder during resin molding is reduced and dimensional variations of the front holder are small. As a result, displacements between the cavities of the second cavity group and walls and openings of the front holder are suppressed.

The supports in the cavities of the first cavity group for supporting front ends of the terminal fittings take advantage of a difference between the width of the cavities and the width of the locks.

Supports are not formed in the cavities of the second cavity group due to a smaller difference between the width of the cavities and the width of the locks as compared to the corresponding difference in the cavities of the first cavity group.

The front holder corresponds only to the narrow cavity group, and hence has a smaller area as compared to a front holder that corresponds to all cavities. Thus, shrinkage of the front holder during resin molding is suppressed, and dimensional variations of the front holder are small. As a result, displacements between the smaller cavities and wall portions and openings of the front holder corresponding to the smaller cavities are suppressed.

A recess preferably is formed in the front surface of the housing for accommodating the front holder, and the front surface of the front holder is substantially flush with the front surface of the housing when the front holder is accommodated properly in the recess.

The front holder forms only part of the front surface of the housing. However, the front of the housing can be substantially flat because the front surfaces of the front holder and the housing are substantially flush when assembled. Thus, the shape of the front surface of the housing is simple.

The front holder preferably is mounted to the housing in a mounting direction arranged at an angle to an inserting direction of the terminal fittings into the respective cavities, and preferably a right angle.

The mounting of the front holder to the housing may be guided by engaging at least one guide groove with a corresponding guide rib. The guide grooves and the guide ribs preferably are dovetail shaped or undercut.

Locking means preferably locks the properly mounted front holder to the housing.

The invention also relates to a method of assembling a connector with first and second cavity groups. The method comprises assembling the housing with a front holder that corresponds only to the second cavity group to form front ends of the cavities of the second cavity group and providing supports for supporting the front ends of the terminal fittings in the cavities of the second cavity group. The method then comprises inserting terminal fittings into the corresponding cavities.

The front holder preferably is inserted into a recess in the front surface of the housing so that the front surface of the front holder is substantially flush with the front surface of the housing when the front holder is accommodated properly in the recess.

The front holder preferably is assembled to the housing in a mounting direction arranged at an angle, and preferably a right angle, to an inserting direction of the terminal fittings into the respective cavities.

The assembling step preferably comprises guiding the front holder to the housing by engaging at least one guide groove with a guide rib. The guide groove and the guide rib preferably are dovetailed or undercut.

The method may further comprise locking the front holder to the housing when properly mounted.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention has a housing 10 made e.g. of a synthetic resin. The housing 10 defines a substantially rectangular block, and has left and right wide cavity groups 11L and one narrow cavity group 11S between the wide cavity groups 11L.

Figure 9:
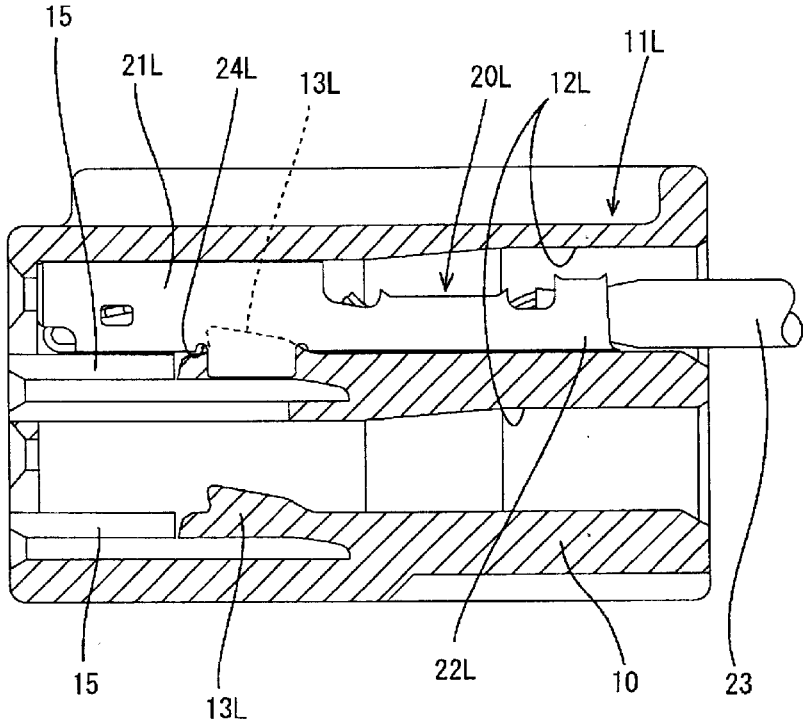
FIG. 9 is a section with a large terminal fitting in a large cavity.

Each wide cavity group 11L includes large cavities 12L arrayed substantially along vertical and transverse directions. Each large cavity 12L is narrow and long in forward and backward directions and has a substantially rectangular cross-section. Large terminal fittings 20L are inserted into the large cavities 12L in an inserting direction ID. A resilient deformable lock 13L projects forward along the bottom wall of each large cavity 12L for locking the corresponding large terminal fitting 20L in the large cavity 12L. A mold-removing space is defined at the left and right sides before the lock 13L to accommodate a mold (not shown) for forming the lock 13L. The large cavity 12L is wider than the lock 13L, and left and right supports 15 project from the inner side surfaces of the large cavity 12L in the area of the lock 13L and before the lock 13L (FIG. 9). Each support 15 is a narrow rib that extends forward and back parallel with the longitudinal direction of the large cavity 12L and along the inserting direction ID of the large terminal fitting 20L. The left and right sides of the front end of the large terminal fitting 20L are supported from below in the large cavity 12L by the two supports 15.

A front part of each large terminal fitting 20L defines a substantially rectangular tube 21L and a rear part thereof defines a wire crimping portion 22L to be crimped, bent or folded into connection with a wire 23. The rectangular tube 21L of the large terminal fitting 20L causes the lock 13L to deform resiliently down during insertion of the large terminal fitting 20L into the large cavity 12L. The lock 13L is restored resiliently when the large terminal fitting 20L reaches a proper insertion position to engage an engaging portion 24L of the rectangular tube 21L from behind. As a result the large terminal fitting 20L is held so as not to come out. The rectangular tube 21L of the properly inserted large terminal fitting 20L is supported by the supports 15 from below or from a lateral side, and preferably substantially normal to the inserting direction ID.

The narrow cavity group 11S includes small cavities 12S arrayed along vertical and transverse directions. Each small cavity 12S is narrow and long in forward and backward directions and has a substantially rectangular cross-section. The small cavities 12S are narrower and shorter than the large cavities 12L. Additionally, transverse and vertical spacings between the small cavities 12S are less than the spacings between the large cavities 12L. A small terminal fitting 20S is inserted into each small cavity 12S in the inserting direction ID. A lock 13S for locking the small terminal fitting 20S projects forward toward the mating side substantially along the bottom wall of the small cavity 12S. The lock 13S is resiliently deformable down in a direction retracted from an insertion path for the small terminal fitting 20S.

A mold-removing space for a mold (not shown) that forms the lock 13S is defined at the left and right sides of the lock 13S and before the lock 13S. The small cavity 12S is only slightly wider than the lock 13S. Thus, the small cavity 12S has no means corresponding to the supports 15 in an area of the large cavity 12L at the left and right sides of the lock 13S and before the lock 13S. Accordingly, front ends of the small terminal fittings 20S inserted into the small cavities 12S cannot be supported from below.

A recess 16 is formed in an area of the front surface of the housing 10 corresponding to the narrow cavity group 11S. The recess 16 is open in the front and the bottom surface of the housing 10, and a front holder 30 can be inserted into the recess 16 in a mounting direction MD, through an opening formed in the bottom surface of the housing 10. The mounting direction MD of the front holder 30 is substantially normal to the inserting direction ID of the terminal fittings 20S into the respective cavities 12S. All of the small cavities 12S open to the back end surface of the recess 16 that is substantially normal to an inserting direction ID of the small terminal fittings 12S. Additionally, the front ends of the locks 13S are close to the back end surface of the recess 16.

Figure 4:
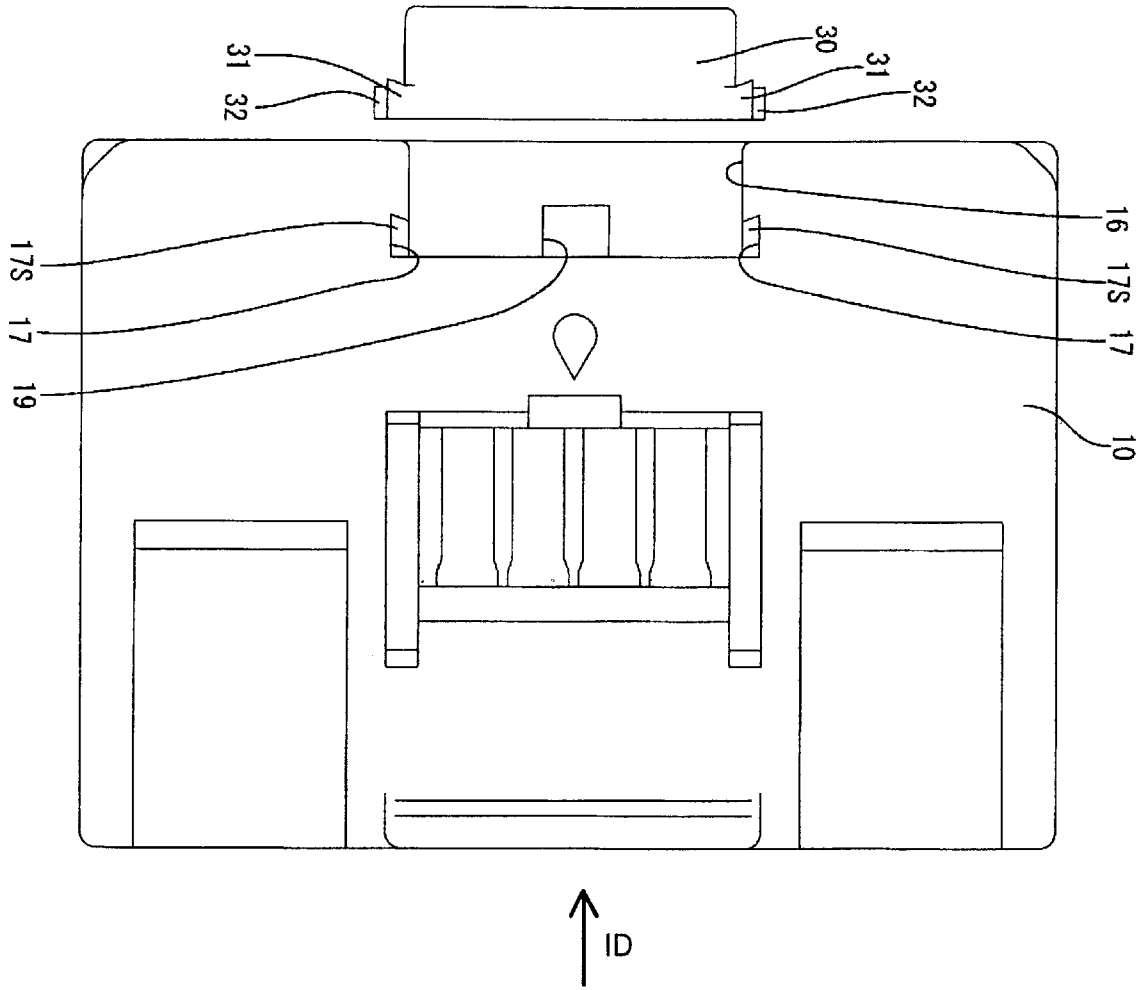
FIG. 4 is a bottom view with the front holder detached from the housing.
Figure 5:
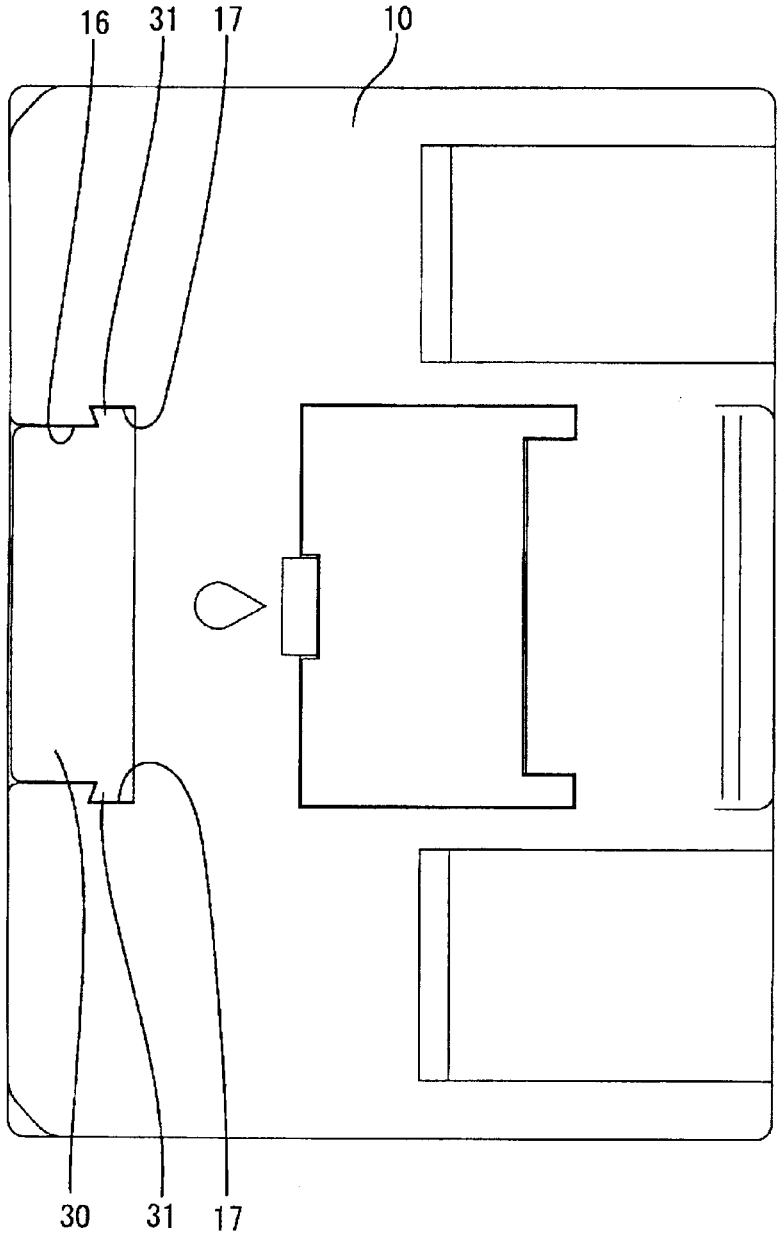
FIG. 5 is a bottom view of the front holder assembled with the housing.
Figure 6:
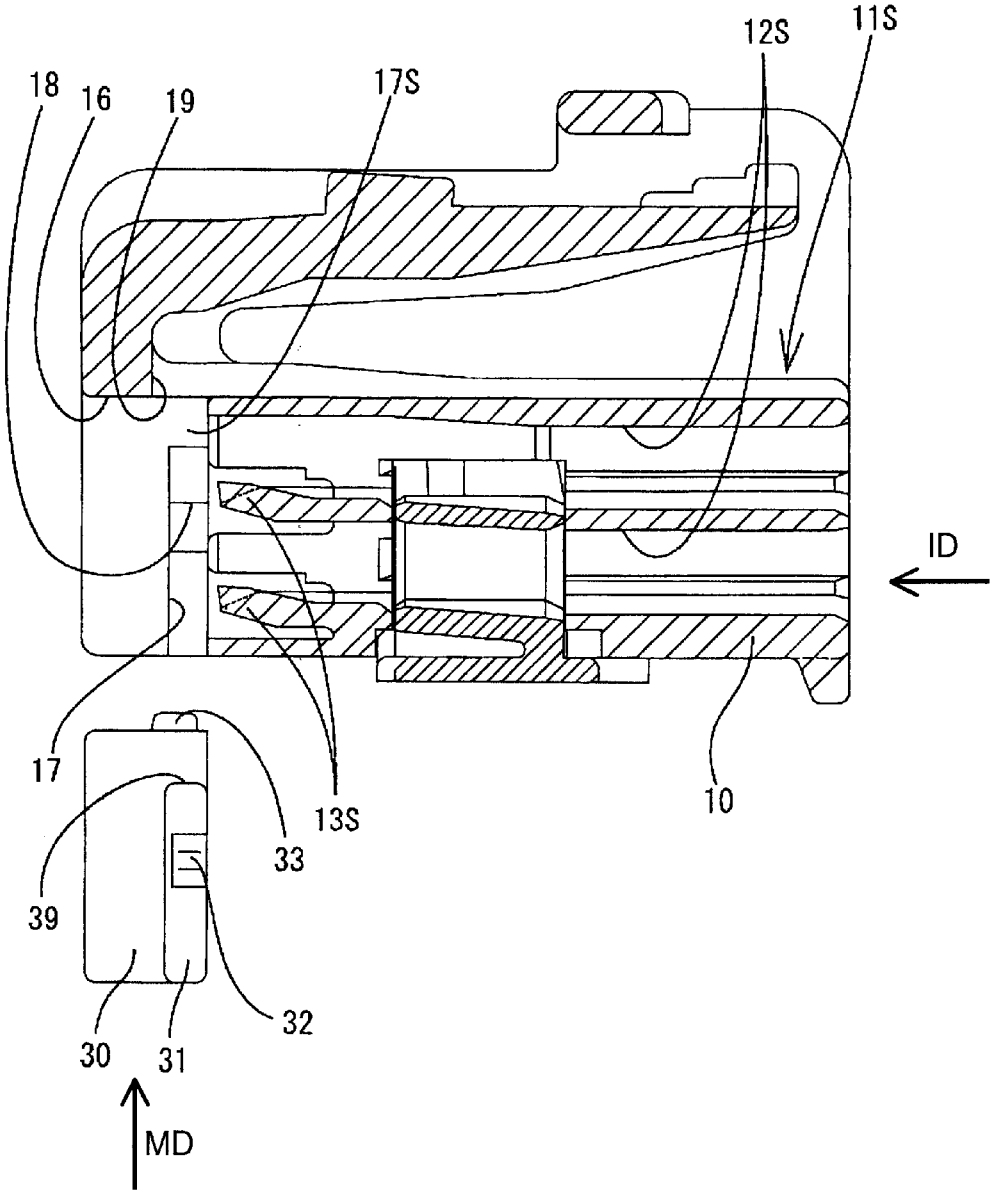
FIG. 6 is a section with the front holder detached from the housing.
Figure 10:
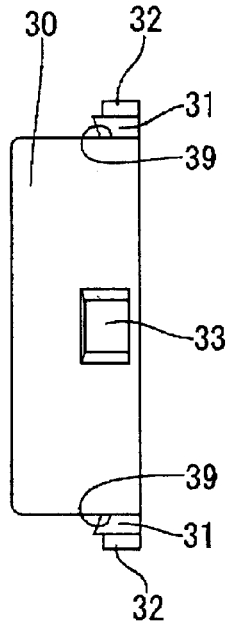
FIG. 10 is a plan view of the front holder.
Figure 11:
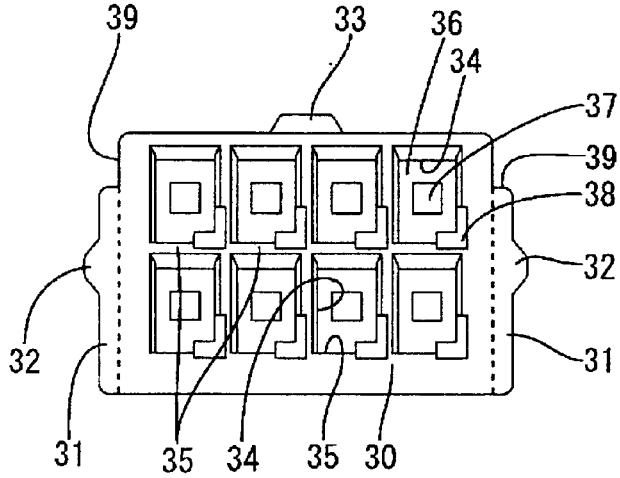
FIG. 11 is a rear view of the front holder.

Vertically aligned dovetail guide grooves 17 are formed respectively in the inner left and right surfaces of the recess 16 (FIGS. 4, 5, 10). The guide grooves 17 are transversely symmetrical and extend substantially normal to the inserting direction ID of the small terminal fittings 20S into the small cavities 12S. The rear inner surface of each guide groove 17 is substantially continuous and flush with the back end surface of the recess 16, whereas the front inner surface thereof is oblique to the rear inner surface. The bottom ends of the guide grooves 17 open at the bottom surface of the housing 10, and guide ribs 31 of the front holder 30 are fit into the guide grooves 17 in the mounting direction MD from below. The front holder 30 is mounted into the recess 16 by engaging the guide grooves 17 and the guide ribs 31. Further, each guide groove 17 is cut away at an intermediate height position to form a fastening hole 18. The fastening holes 18 prevent the front holder 30 from downward withdrawal from the recess 16 and open in the front surface of the housing 10 via mold-removing holes 18H.

A widthwise center of the ceiling of the recess 16 is cut away to form a locking hole 19. The locking hole 19 receives a locking projection 33 of the front holder 30 when the front holder 30 is mounted properly in the recess 16.

A thick substantially rectangular plate-shaped front holder 30 is closely fittable into the recess 16 along a mounting direction MD. The vertical dimension along the mounting direction MD, and the width and thickness of the front holder 30 are substantially equal to corresponding dimensions of the recess 16. Thus, the front surface of the front holder 30 is substantially flush with the front surface of the housing 10 and the bottom surface of the front holder 30 is flush with the bottom surface of the housing 10 when the front holder 30 is mounted properly in the recess 16.

Transversely symmetrical guide ribs 31 are formed on the left and right surfaces of the front holder 30 and extend substantially straight and vertically along the mounting direction MD. The guide ribs 31 are shaped to fit closely in the guide grooves 17 of the recess 16 so as not to shake to front, back, left or right. The rear and bottom surfaces of the guide ribs 31 are substantially continuous and flush with the rear and bottom surfaces of the guide grooves 17. A trapezoidal fastening projection 32 is formed on each of the outer surfaces of the guide ribs 31. The fastening projections 32 fit in the fastening holes 18 of the recess 16 when the front holder 30 is mounted properly in the recess 16 to prevent the front holder 30 from loose downward movements and forward withdrawal from the recess 16. A locking projection 33 projects up in the mounting direction MD at substantially the widthwise center of the upper surface of the front holder 30. The rear surface of the locking projection 33 is substantially continuous and flush with the rear surface of the front holder 30. The locking projection 33 fits into the locking hole 19 of the recess 16 from below when the front holder 30 is mounted properly.

Substantially rectangular terminal accommodating portions 34 are formed in the rear surface of the front holder 30 and correspond to the small cavities 12S. The width and height of the terminal accommodating portions 34 substantially equal the width and height of the small cavities 12S. Upper, lower, left and right walls of the terminal accommodating portions 34 are substantially flush with the ceiling, bottom, left and right surfaces of the corresponding small cavities 12S when the front holder 30 is mounted properly in the recess. 16. The bottom walls of the terminal accommodating portions 34 serve as supports 35 for supporting the front ends of the small terminal fittings 20S in the small cavities 12S. The front end of each terminal accommodating portion 34 has a front-stop wall 36 with a tab insertion opening 37 and a jig insertion opening 38. The outer front surfaces of a plurality of front-stop walls 36 form the flat front surface of the front holder 30.

A front part of each small terminal fitting 20S is formed into a substantially rectangular tube 21S and a rear part thereof is formed into a wire crimping portion 22S for crimped, bent or folded connection with the wire 23. The rectangular tube 21S of the small terminal fitting 20S resiliently deforms the lock 13S down in the process inserting the small terminal fitting 20S into the small cavity 12S. The lock 13S is restored resiliently and engages an engaging portion 24S of the rectangular tube 21S from behind when the small terminal fitting 20S reaches a proper insertion position. As a result the small terminal fitting 20S is held so as not to come out. The front end of the properly inserted rectangular tube 21S is supported from below by the support 35 of the front holder 30 assembled with the housing 10.

The housing 10 is formed with mount-preventing portions 17S and the front holder 30 is formed with notches 39 to prevent the front holder 30 from being mounted in an improper posture (e.g. turned upside down with respect to the recess 16). The mount-preventing portions 17S are substantially rectangular solid portions at the upper ends of the respective guide grooves 17, which are the back ends with respect to the mounting direction MD of the front holder 30 into the recess 16. The bottom surfaces of the mount-preventing portions 17S are below the ceiling surface of the recess 16, which is the surface substantially contacted by the upper end of the front holder 30 when the front holder 30 has been mounted properly in the recess 16. The notches 39 are substantially rectangular recesses on the upper ends of the guide ribs 31 so that the upper ends of the guide ribs 31 are below the upper surface of the front holder 30. The depth of the notches 39 substantially equals the length of the mount-preventing portions 17S. Thus, with the front holder 30 properly mounted in the recess 16, the notches 39 and the mount-preventing portions 17S nest with almost no clearance therebetween.

The front holder 30 is mounted by inserting the upper end of the front holder 30 slightly into the recess 16 from the bottom of the housing 10 so that the upper ends of the guide ribs 31 fit into the bottom ends of the guide grooves 17. The front holder 30 then is slid up in the mounting direction MD and is held in a proper posture by the engagement of the guide grooves 17 and the guide ribs 31. The fastening projections 32 project more outward than the guide ribs 31 in the front holder 30. Thus, the housing 10 tries to undergo a resilient deformation to widen the recess 16 and simultaneously the front holder 30 tries to undergo a resilient deformation to narrow the recess 16.

Figure 1:
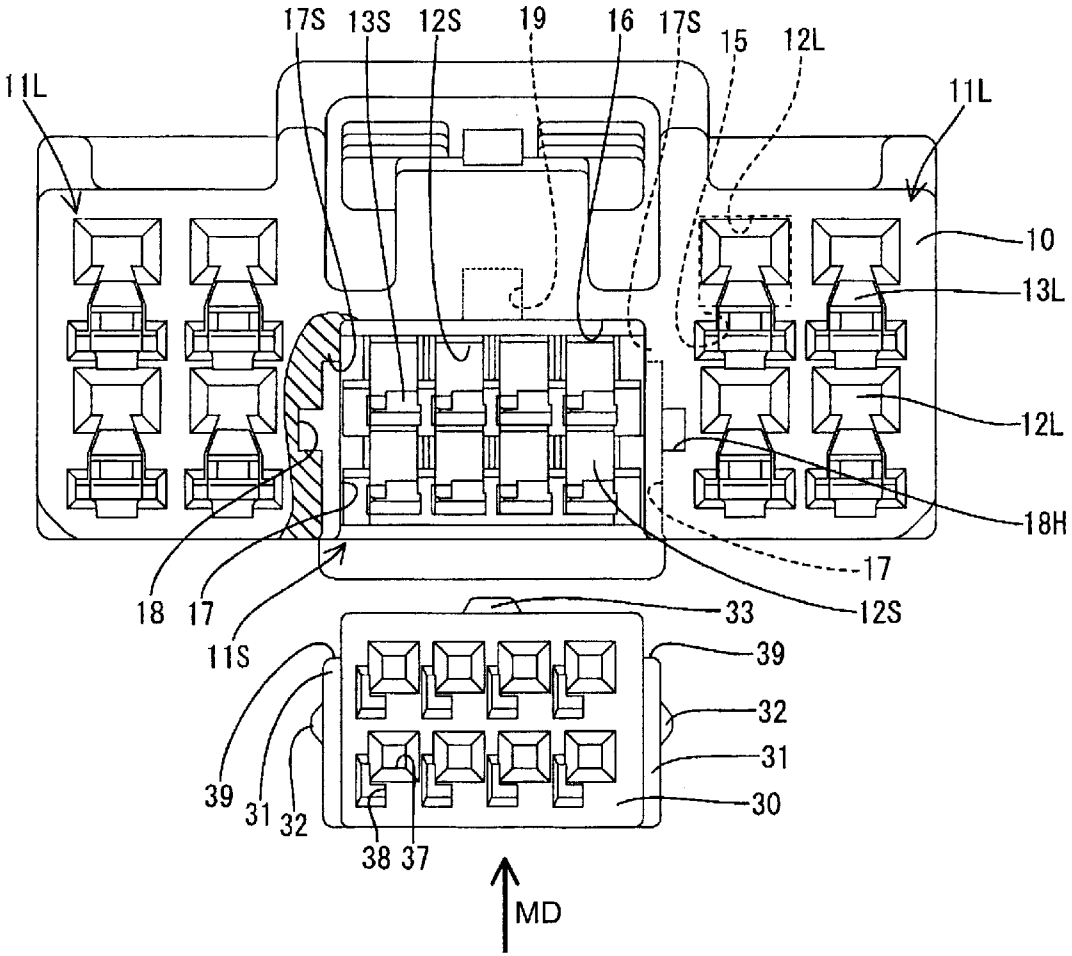
FIG. 1 is a front view partly in section showing a front holder detached from a housing.
Figure 2:
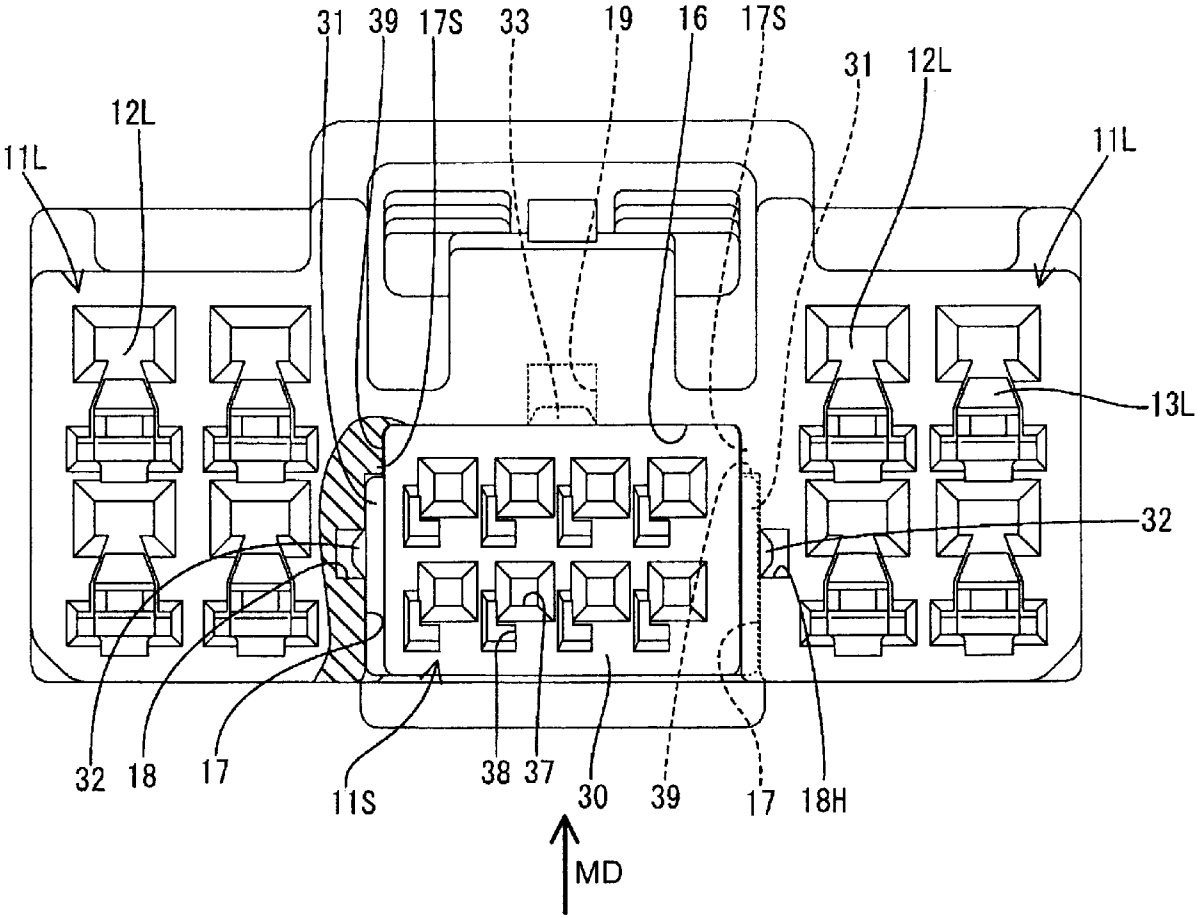
FIG. 2 is a front view partly in section showing the front holder is assembled with the housing.
Figure 7:
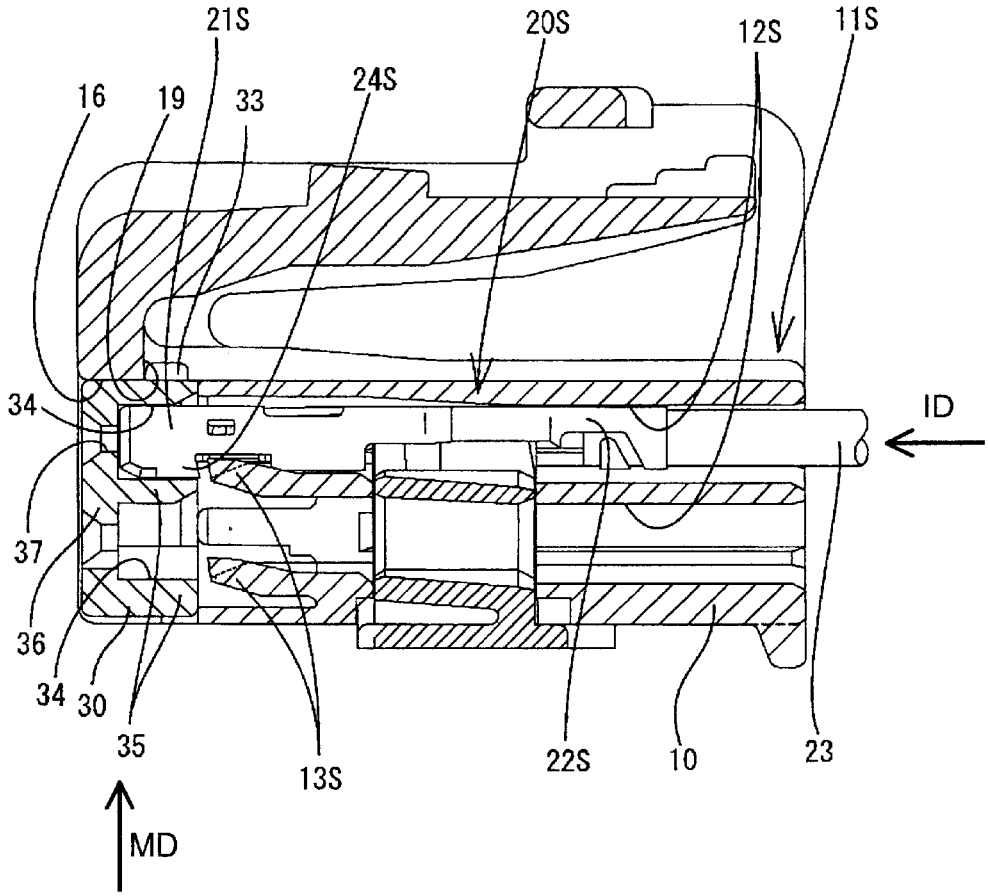
FIG. 7 is a section with the front holder assembled with the housing.
Figure 8:
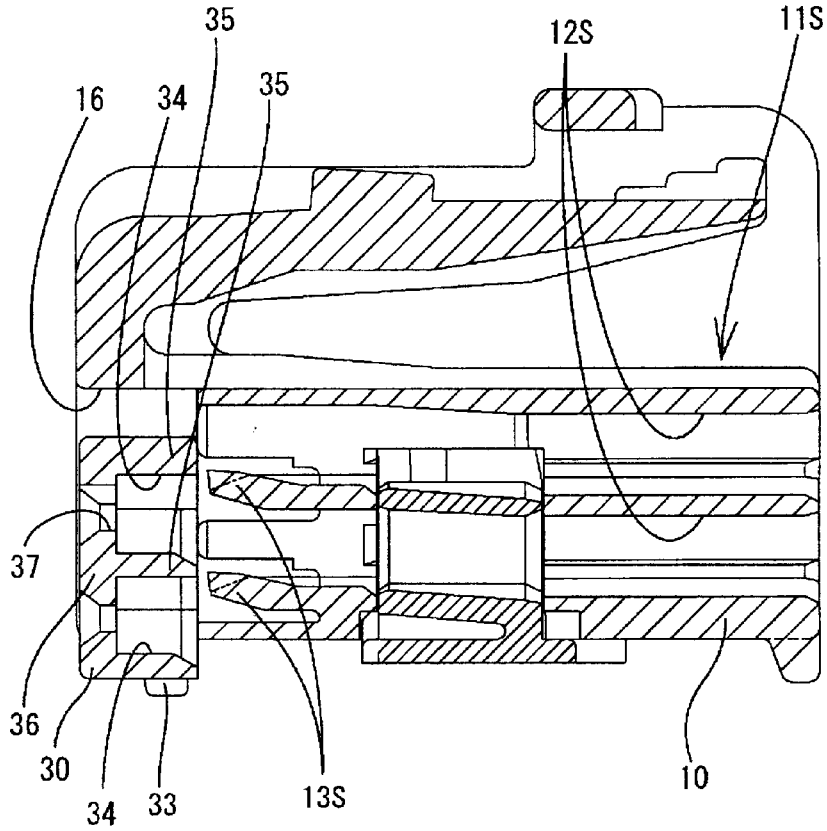
FIG. 8 is a section with the front holder mounted upside down.

The mount-preventing portions 17S and the notches 39 engage and the upper surface of the front holder 30 substantially contacts the ceiling of the recess 16 when the front holder 30 is mounted to a proper position (see FIGS. 2 and 7). The fastening projections 32 engage the fastening holes 18 in this state, and prevent the front holder 30 from loose downward movements and withdrawal from the recess 16. Further, the front holder 30 is prevented from loose forward movements and forward withdrawal from the recess 16 by the engagement of the guide grooves 17 and the guide ribs 31 and by the engagement of the locking projection 33 and the locking hole 19. In this way, the front holder 30 is locked in its properly mounted state.

In this state, the terminal accommodating portions 34 of the front holder 30 face the corresponding small cavities 12S, and are ready for insertion of the small terminal fittings 20S. Additionally, the front and bottom surfaces of the front holder 30 are substantially flush with the front and bottom surfaces of the housing 10. The small terminal fittings 20S are inserted into the small cavities 12S after the front holder 30 is mounted, and the front ends of the rectangular tubes 21S of the small terminal fittings 20S are inserted into the terminal accommodating portions 34. Thus, the supporting portions 35 of the front holder 30 support the rectangular tubes 21S from below (see FIG. 7).

Figure 3:
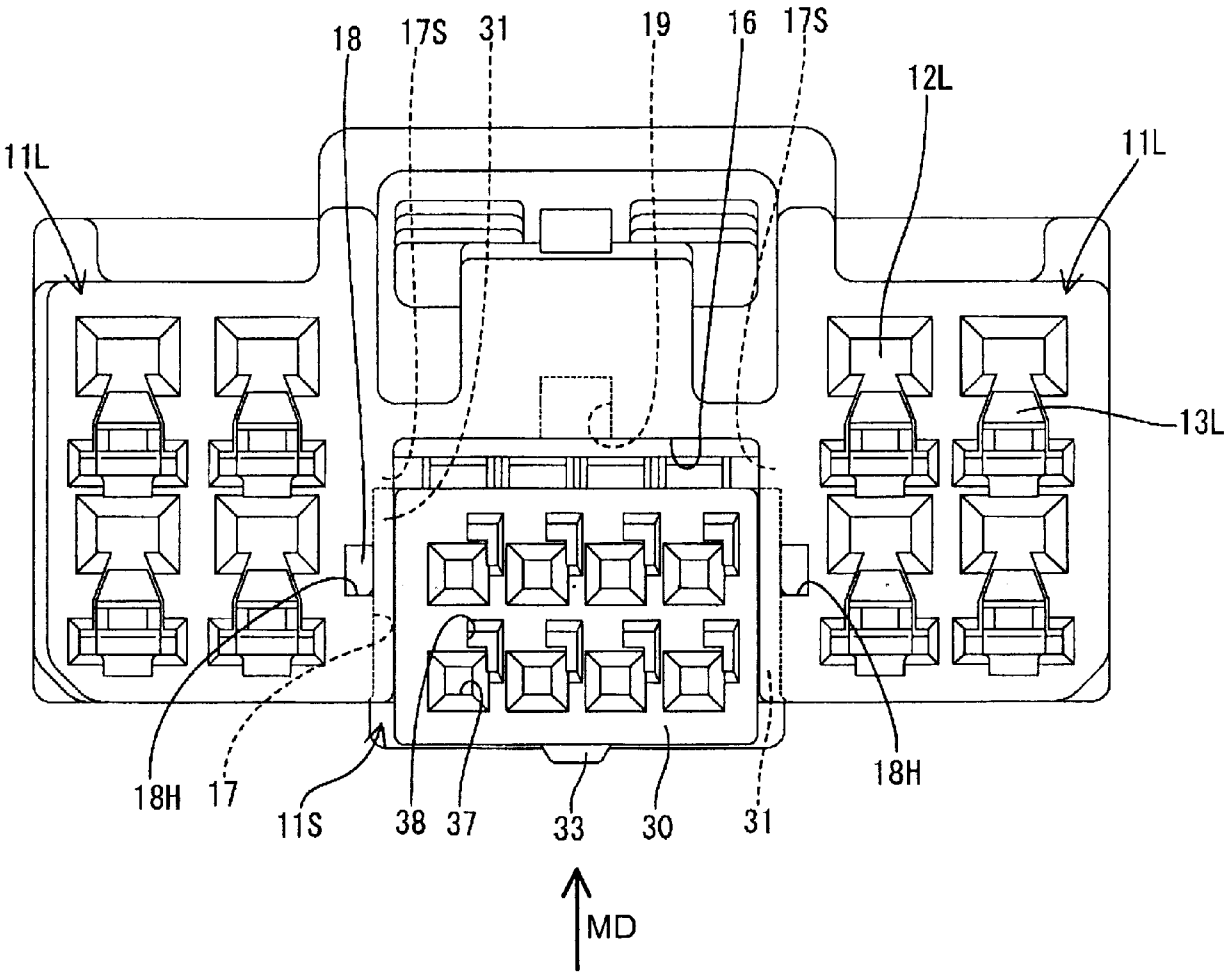
FIG. 3 is a front view partly in section showing the front holder mounted upside down into the housing.

The front holder 30 could be inverted during an attempted insertion into the recess 16. In this case, the guide ribs 3 fit into the bottom ends of the guide grooves 17 at an initial stage of the mounting operation and then the front holder 30 continues to be fit into the recess 16. The upper ends of the guide ribs 31 (bottom ends in the proper posture of the front holder 30) contact the mount-preventing portions 17S from below before the upper surface of the front holder 30 reaches the ceiling of the recess 16 and prevent the front holder 30 from being mounted any further (see FIG. 3). In this state, part of the front holder 30 projects from the bottom surface of the housing 10, and the projecting state can be seen from the front or side of the housing 10. Hence the improper mounting of the front holder 30 can be detected. The terminal accommodating portions 34 are below the small cavities 12S in this improperly mounted state. Thus, the rectangular tube 21S would interfere with the rear surface of the front holder 30 if an attempt were made to insert the small terminal fitting 20S into the small cavities 12S. The improper mounting posture can be confirmed visually to prevent the front holder 30 from being mounted in the improper posture.

Portions of the housing 10 that have the guide grooves 17 are thinned, and therefore have lower rigidity. However, the mount-preventing portions 17S at the back ends of the guide grooves 17 improve the rigidity.

The front holder 30 corresponds only to the narrow cavity group 11S. Thus, the front holder 30 has a smaller area than a front holder that corresponds to both the wide cavity groups 11L and the narrow cavity group 11S. Accordingly, the degree of shrinkage of the front holder 30 during resin molding is suppressed, and dimensional variations of the front holder 30 are smaller. As a result, displacements between the small cavities 12S and the walls and openings of the front holder 30 corresponding to the small cavities 12S are suppressed.

The front holder 30 forms only part of the front surface of the housing 10. Additionally, the front surfaces of the front holder 30 and the housing 10 are substantially flush with each other. Thus, the front surface of the housing 10 can be flat, and the shape of the front surface of the housing 10 is simple.

The invention is not limited to the above described and illustrated embodiment. For example, the following embodiments also are embraced by the technical scope of the present invention as defined by the claims. Beside the following embodiments, various changes can be made without departing from the scope and spirit of the present invention as defined by the claims.

The small cavities of the narrow cavity group are gathered at one location in one housing in the foregoing embodiment. However, the invention also is applicable to connectors with a plurality of narrow cavity groups located in one housing.

The narrow cavity group is in the widthwise center of the housing in the foregoing embodiment. However, the invention also is applicable to connectors where the narrow cavity group is more towards either the left or right side.

Although the front holder is mounted in the direction MD substantially normal to the inserting direction of the terminal fittings in the foregoing embodiment, the front holder may be mounted in a direction substantially parallel with the inserting direction ID of the terminal fittings.

What is claimed is:

1. A connector, comprising:

a housing having front and rear surfaces, said housing being formed with cavities extending between the front end and rear surfaces and locks extending substantially along inner walls of the respective cavities, a recess being formed in the front surface of the housing;

the cavities comprising first and second cavity groups, the cavities in the first cavity group being formed with supports for supporting front ends of terminal fittings, and the second cavity group being aligned with the recess in the front surface of the housing, the cavities in the second cavity group being formed without supports; and a front holder assembled in the recess in the front surface of the housing and corresponding only to the cavities of the second cavity group, the front holder including supports for supporting the front ends of terminal fittings inserted into the cavities of the second cavity group.

2. The connector of claim 1, wherein the supports in the first cavity group are in positions corresponding to a difference between widths of the cavities and the locks.

3. The connector of claim 2, wherein a difference between widths of the cavities and the locks in the second cavity group is less than the difference between widths of the cavities and the locks in the first cavity group.

4. The connector of claim 1, wherein the housing has guide grooves and the front holder has guide ribs engaged with the guide grooves.

5. The connector of claim 4, wherein the guide grooves and the guide ribs are dovetail shaped.

6. The connector of claim 1, further comprising a lock for locking the front holder to the housing in a properly mounted position.

7. A connector comprising:

a housing formed with cavities and locks extending substantially along inner walls of the respective cavities;

the cavities comprising first and second cavity groups, the first cavity group having a plurality of cavities formed with supports for supporting front ends of terminal fittings, and the second cavity group having cavities without supports;

a front holder assembled with the housing and corresponding only to the cavities of the second cavity group, the front holder including supports for supporting the front ends of terminal fittings inserted into the cavities of the second cavity group;

wherein a recess is formed in the front surface of the housing for accommodating the front holder, the front surface of the front holder being substantially flush with the front surface of the housing when the front holder is accommodated in the recess.

8. The connector of claim 7, wherein the front holder is mounted to the housing in a mounting direction arranged substantially normal to the respective cavities.

9. A method of assembling a connector having a housing formed with a plurality of cavities and locks extending substantially along inner walls of the cavities, the cavities including a first cavity group with a first plurality of cavities formed with supports for supporting front ends of terminal fittings, and a second cavity group formed with a second plurality of cavities without supports, comprising the steps of:

assembling a front holder into a recess formed in a front surface of the housing, such that the front holder substantially corresponds only to the second cavity group and such that a front surface of the front holder is substantially flush with a front surface of the housing when the front holder is accommodated properly in the recess, thereby forming front ends of the cavities of the second cavity group and providing supports for supporting the front ends of the terminal fittings inserted into the cavities of the second cavity group, and inserting terminal fittings into the corresponding cavities and locking them by the locks.

10. The method of claim 9, wherein the supports in the first cavity group are disposed in positions corresponding to a difference between widths of the cavities and the locks.

11. The method of claim 10, wherein a difference between widths of the cavities and the locks in the second cavity group is less than the difference between widths of the cavities and the locks in the first cavity group.

12. The method of claim 9, wherein in the assembling step the front holder is assembled to the housing in a mounting direction which is substantially normal to an inserting direction of the terminal fittings into the respective cavities.

13. The method of claim 12, wherein the assembling step comprises guiding the front holder to the housing by engaging guide grooves with corresponding guide ribs.

14. The method of claim 3, wherein the guide grooves and the guide ribs are dovetail shaped.

15. The method of claim 9, further comprising the step of locking the front holder to the housing when being substantially properly mounted.

* * * * *